US008837973B2

(12) United States Patent
Soda

(10) Patent No.: US 8,837,973 B2
(45) Date of Patent: Sep. 16, 2014

(54) IMAGE PROCESSING APPARATUS, CONTROL METHOD THEREOF, AND STORAGE MEDIUM

(71) Applicant: Canon Kabushiki Kaisha, Tokyo (JP)

(72) Inventor: Yuji Soda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 13/710,178

(22) Filed: Dec. 10, 2012

(65) Prior Publication Data

US 2013/0209132 A1 Aug. 15, 2013

(30) Foreign Application Priority Data

Feb. 15, 2012 (JP) ..... 2012-031042

(51) Int. Cl.
*G03G 21/00* (2006.01)
*G03G 15/00* (2006.01)

(52) U.S. Cl.
CPC ..... *G03G 15/5004* (2013.01)
USPC ..... 399/75; 399/88

(58) Field of Classification Search
USPC ..... 399/37, 75, 76, 77, 88
See application file for complete search history.

(56) References Cited

U.S. PATENT DOCUMENTS 6,895,196 B2 * 5/2005 Uchizono et al. ..... 399/75
7,283,262 B2 * 10/2007 Takeda et al. ..... 358/1.14

FOREIGN PATENT DOCUMENTS

JP 2008-142942 A 6/2008

* cited by examiner

*Primary Examiner* — Hoang Ngo
(74) *Attorney, Agent, or Firm* — Fitzpatrick, Cella, Harper & Scinto

(57) ABSTRACT

The present invention provides an image processing apparatus for performing a process of transiting to a power-off state or sleep state in accordance with the connected state of an interface, a control method thereof, and a storage medium. To accomplish this, if a condition for changing the power state of this image processing apparatus is satisfied, the image processing apparatus confirms an interface which is able to communicate with an external apparatus, and determines whether the image processing apparatus can transit to the sleep state based on the confirmation result. If it is determined that the image processing apparatus transits to the sleep state, the image processing apparatus is transited to the sleep state. If it is determined that the image processing apparatus does not transit to the sleep state, the image processing apparatus is turned off.

9 Claims, 5 Drawing Sheets

| CONNECTED STATE (601) | 0.5 W OR LESS (602) | PRIORITY ORDER (603) |
|---|---|---|
| USB | ○ | — |
| LAN | ○ | — |
| WLAN | × | — |
| USB+LAN | × | LAN |
| WLAN+USB | × | USB |
| WLAN+LAN | × | LAN |
| WLAN+LAN+USB | × | LAN |

600

IMAGE PROCESSING APPARATUS, CONTROL METHOD THEREOF, AND STORAGE MEDIUM

BACKGROUND OF THE INVENTION

1. Field of the Invention

The present invention relates to an image processing apparatus having power saving control, a control method thereof, and a storage medium.

2. Description of the Related Art

Recently, computer peripheral devices including printers have been required to reduce the energy consumption from the viewpoint of global environment preservation. As the international standards, a peripheral device satisfying predetermined conditions is required to automatically transit to a low power consumption state. Accordingly, energy saving and user friendliness are important themes of device development.

Also, a device having an automatic power-off function in order to reduce the power consumption even in the lower power consumption state has been developed. Especially in recent years, energy saving leads to the saving of electricity charge and the reduction in $CO_2$ exhaustion amount, so users are taking a growing interest. In addition, enterprises cannot ignore energy saving as social responsibility regardless of the enterprise scales, and are extensively developing energy saving techniques.

As a method of controlling the transition to the lower power consumption state, Japanese Patent Laid-Open No. 2008-142942 has described a method of performing the control when a predetermined time has elapsed after a printing operation is stopped. In this method, a time zone in which no printing is performed is preset. When transiting to a sleep mode, the power source is turned off if the time is in this predetermined time zone; if not, the control transits to the sleep mode.

Unfortunately, the above-mentioned prior art has the following problems. In the above prior art, in the control of transiting to the sleep mode if no printing operation is performed for a predetermined time, a time zone during which no printing is performed is preset, and the power source is turned off if the time is in this predetermined time zone; if not, the control transits to the sleep mode. That is, when transiting to the sleep mode or power-off mode, a time zone during which no printing is performed is predetermined, and judgment is performed based on the range of this time zone alone.

Also, when the power source is once turned off, it takes a long time to return to a usable state, unlike when standing by in the sleep state. Especially when using a printer across a network, many users use the printer, so it is difficult to grasp the use statuses of all the users. In addition, some apparatuses consume high power when the power source is turned on or off. Therefore, the energy saving effect worsens if ON and OFF of the power source occur within a short time.

SUMMARY OF THE INVENTION

The present invention enables realization of an image processing apparatus that performs a process of transiting to a power-off state or sleep state in accordance with the connected state of an interface, a control method thereof, and a storage medium.

One aspect of the present invention provides an image processing apparatus comprising a plurality of interfaces for connecting an external apparatus, comprising: a confirmation unit configured to confirm, in a case where a condition for changing a power state of the image processing apparatus is satisfied, an interface which is able to communicate with an external apparatus; a determination unit configured to determine, based on a confirmation result by the confirmation unit, whether or not the image processing apparatus transits to a sleep state in which at least one of the plurality of interfaces is communicable; and a power control unit configured to transit the image processing apparatus to the sleep state if the determination unit has determined that the image processing apparatus transits to the sleep state, and transit the image processing apparatus to a power-off state in which the plurality of interfaces are incommunicable if the determination unit has determined that the image processing apparatus does not transit to the sleep state.

Another aspect of the present invention provides a control method for an image processing apparatus comprising a plurality of interfaces for connecting an external apparatus, comprising: confirming, by a confirmation unit, in a case where a condition for changing a power state of the image processing apparatus is satisfied, an interface which is able to communicate with an external apparatus; determining, by a determination unit, based on a confirmation result by the confirmation unit, whether or not the image processing apparatus transits to a sleep state in which at least one of the plurality of interfaces is communicable; and controlling, by a power control unit, to transit the image processing apparatus to the sleep state if the determination unit has determined that the image processing apparatus transits to the sleep state, and transit the image processing apparatus to a power-off state in which the plurality of interfaces are incommunicable if the determination unit has determined that the image processing apparatus does not transit to the sleep state.

Still another aspect of the present invention provides a computer-readable storage medium storing a computer program for causing a computer to execute each step in a control method for an image processing apparatus.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<First Embodiment>

<Arrangement of Image Processing Apparatus>

Figure 1:
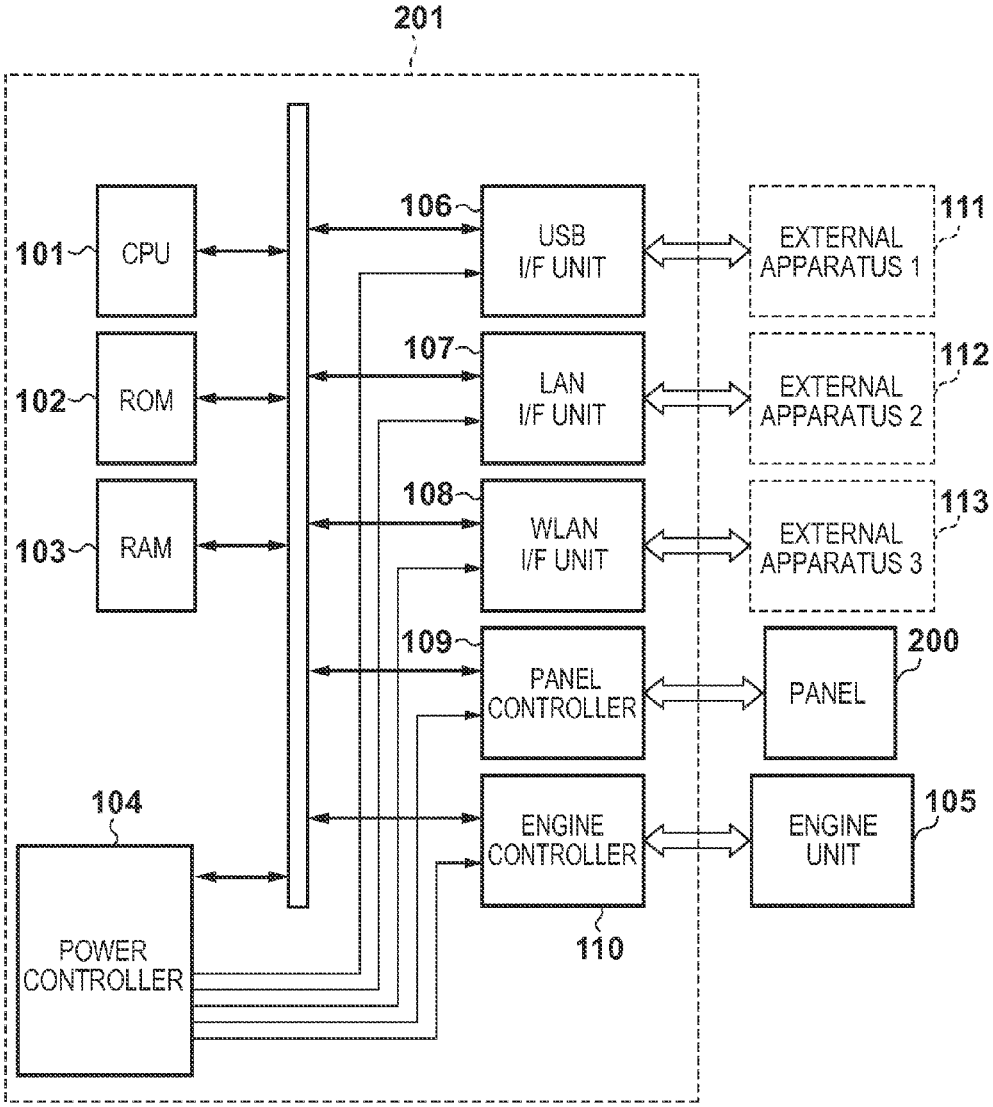
FIG. 1 is a view showing the configuration of a printing system according to the first embodiment.
Figure 2:
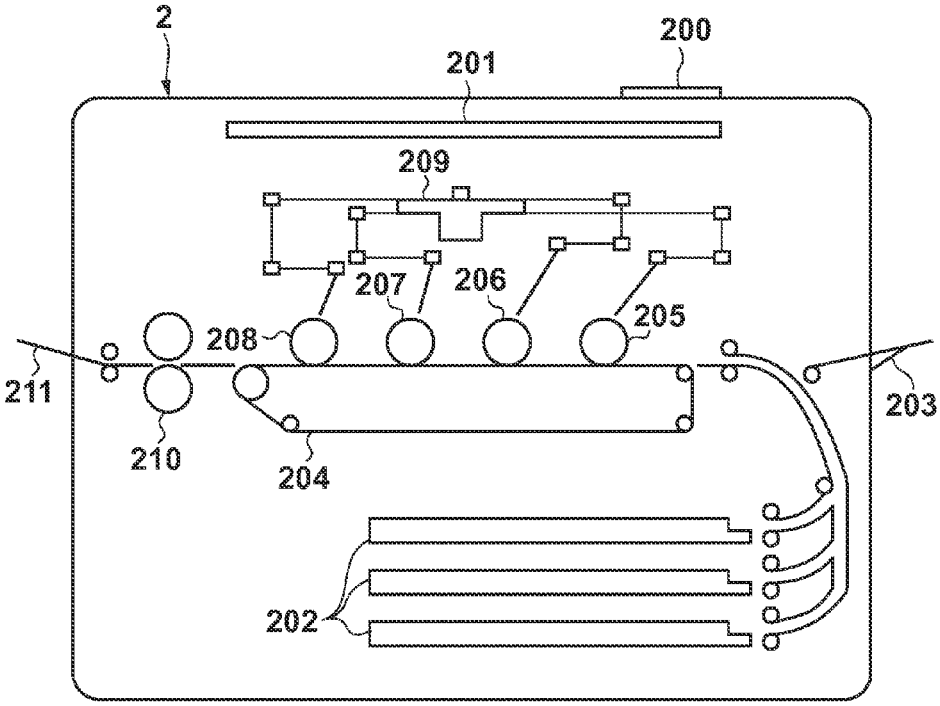
FIG. 2 is a sectional view showing an outline of the structure of a printing apparatus according to the first embodiment.

The first embodiment of the present invention will be explained below with reference to FIGS. 1 to 3 and 5. Frist, an arrangement example of a printer 2 as an image processing apparatus according to this embodiment will be explained with reference to FIG. 2. As shown in FIG. 2, the printer 2 includes an operation panel 200, a printer control unit 201, a paper feed cassette 202, a manual feed tray 203, a paper convey unit 204, developing units 205 to 208, a laser scanner unit 209, a fixing unit 210, and a paper discharge tray 211.

The printer 2 receives data from various external apparatuses such as host computers, and executes printing on a printing medium. In this embodiment, a laser beam printer is applied to the printer 2. However, the present invention is not limited to this, and applicable to any image processing apparatus connectable to a network.

The printer 2 receives print information (for example, a character code), form pattern information, or compressed image data supplied from a connected external host computer. The input image data is stored, and a corresponding character pattern or form pattern is formed in accordance with the information, or an image is formed on printing paper as a printing medium while the compressed image data is rasterized.

The operation panel 200 includes switches and LED indicators for various operations. The printer control unit (controller) 201 executes overall control in the printer 2, and analyzes character information and the like supplied from a host computer or the like. The printer control unit 201 mainly converts character information into a video signal having a corresponding character pattern, and transfers compressed image data to the laser scanner unit 209 while rasterizing the data.

When printing is started, the printer 2 starts a paper feed operation of feeding printing paper into the apparatus from the paper feed cassette 202 or manual feed tray 203. The printing paper thus fed is fed to the paper convey unit 204, and conveyed so as to sequentially pass through the developing units 205, 206, 207, and 208. At the same time, the image data of different colors rasterized by the printer control unit 201 are subjected to an image conversion process, and supplied to the laser scanner unit 209.

The laser scanner unit 209 is a circuit for driving a semiconductor laser, and switches ON and OFF of a laser beam emitted from the semiconductor laser in accordance with input image data. Electrostatic latent images are formed on photosensitive drums of the developing units 205, 206, 207, and 208 based on the image data of different colors supplied to the laser scanner unit 209, and the images are developed in accordance with the individual colors, thereby forming desired color images (developer images).

By synchronizing the formation of the image data of different colors with the conveyance of the printing paper, color images of different colors are transferred onto the printing paper conveyed by the paper convey unit 204. Also, a sensor for sensing the residual amount of toner is attached to each of the developing units 205, 206, 207, and 208, and each sensor supplies information to the control system of the printing section in accordance with the reduction in toner. The fixing unit 210 thermally fixes the color images thus printed on the printing paper, and discharges the printing paper to the paper discharge tray 211. In the arrangement of the printer 2 as described above, a printed image can be obtained at very high speed because each color can independently be developed.

<Arrangement of Printer Control Unit>

Details of an arrangement example of the printer control unit 201 in the above-described printer 2 will be explained below with reference to FIG. 1. As shown in FIG. 1, the printer control unit 201 includes a CPU 101, ROM 102, RAM 103, power controller 104, USB I/F unit 106, LAN I/F unit 107, WLAN I/F unit 108, panel controller 109, and engine controller 110.

The interface units 106, 107, and 108 are connected to external apparatuses (for example, host computers), and receive code data and compressed image data from external apparatuses 111 to 113. In accordance with the types of interfaces, the interface units 106 to 108 include independent I/F units, that is, the USB I/F unit 106, LAN I/F unit 107, and WLAN I/F unit 108.

The CPU 101 executes a control program stored in the ROM 102, and comprehensively controls the printer 2. The RAM 103 provides an area for storing printing data to be printed supplied from the host computers, and provides, as a work memory, a work area required when the CPU 101 executes various control operations. The ROM 102 stores various programs (firmware) to be executed by the CPU 101.

The interface units 106 to 108 are connected by interface cables, and exchange control signals and data with the host computers. Data reception is performed by storing image data transferred from the host computer in the RAM 103, and transferring the stored data to the engine controller 110 when printing the data. The engine controller 110 outputs the image data transferred from the RAM 103, in response to a sync signal supplied from the engine unit 105. The panel controller 109 controls information to be displayed on the panel 200, and monitors information of the switches and the like on the panel 200.

The power controller 104 manages the power source of the whole apparatus by monitoring ON/OFF of the main power switch, and controls power supply to each portion of the printer control unit 201. The printer 2 according to this embodiment is controlled to, for example, a standby state, sleep state, or power-off state, as a power control state set by the power controller 104. The standby state is a state in which the printer 2 is activated, printing is immediately executable when a print instruction or the like is received, and electric power is supplied to each device shown in FIG. 1. The power-off state is a state in which power supply to each device shown in FIG. 1 is stopped. The sleep state is a power saving state which is set when no processing is performed for a predetermined time, and in which power is supplied to only minimum necessary devices. Note that the printer 2 according to this embodiment may also be controlled to a suspended state or hibernation state. The suspended state is a state in which power supply to the RAM 103 is maintained and power supply to devices other than the RAM 103 is stopped, and the printer 2 can be activated at high state based on status information stored in the RAM 103. The hibernation state is a state in which power supply to each device shown in FIG. 1 is stopped, as in the power-off state. In this hibernation state, high-speed activation is possible based on status information stored in a hard disk drive (not shown). In the sleep state, the printer 2 according to this embodiment supplies power to only an interface unit in a connected state. Accordingly, communication from an external apparatus in the connected state can be accepted even in the sleep state. Note that the present invention is not limited to this control, and a device to which power is supplied in the sleep state can be changed in accordance with the specifications of a system in which the printer 2 is installed. Note also that the purpose of the printer 2 according to this embodiment is to achieve a predetermined power or less in the sleep state, so power supply can be performed for any device as long as the predetermined power or less can be achieved.

<Interface>

Next, the connection environment between the printer 2 and external apparatuses will be explained with reference to FIG. 5. The external apparatuses 111 to 113 are connected to the interfaces on the printer control unit 201. For example, when connecting an external apparatus by using a USB, the external apparatus 111 is connected to the USB I/F unit 106 by using a USB cable. Consequently, printing can be performed by receiving image data from the external apparatus 111. Similarly, when connecting an external apparatus by using a LAN, the external apparatus 112 is connected to the LAN I/F unit 107. When connecting an external apparatus by using a WLAN, the external apparatus 113 is connected to the WLAN I/F unit 108. As a consequence, the printer 2 can perform printing by receiving image data from the external apparatuses 112 and 113.

<Power Saving Control>

The procedure of power saving control in this embodiment will be explained below with reference to FIG. 3. Processing to be explained below is controlled by the CPU 101 and various programs (firmware) stored in the ROM 102.

When the printer has completed printing, the CPU 101 determines in step S301 whether there is a next print instruction from an external apparatus (for example, a host computer). If there is a print instruction, the process advances to step S302, and the CPU 101 starts the next printing. When the printing is complete, the process returns to step S301.

On the other hand, if there is no printing instruction in step S301, the process advances to step S303, and the CPU 101 determines whether an elapsed time from the completion of printing has exceeded a preset time. If the elapsed time has not exceeded the preset time, the process returns to step S301, and the CPU 101 determines whether there is a print instruction. That is, in this step, the CPU 101 determines whether an elapsed time from the execution of last processing in the printer 2 has exceeded a predetermined time. A condition for clearing a counter that counts the elapsed time in step S303 includes an operation such as cartridge exchange or door open. Note that in step S301, whether the elapsed time has exceeded the preset time is determined. In the present invention, however, it is also possible to determine whether a condition for changing the power state of the image processing apparatus is satisfied. Examples of the condition for changing the power state are a predetermined time, and the remote-controlled reception of a shutoff command from an external apparatus.

If the elapsed time has exceeded the preset time in step S303, the process advances to step S304, and the CPU 101 confirms which of the USB I/F unit 106, LAN I/F unit 107, and WLAN I/F unit 108 is presently in a connected state. After that, the process advances to step S305. "An external apparatus is in a connected state" indicates a state in which the printer 2 is connected to the external apparatus so that communication is possible between them. That is, if an external apparatus is merely physically connected, the external apparatus is not necessarily in the connected state. In step S305, the CPU 101 determines whether a plurality of external apparatus are in the connected state, in accordance with the confirmation result in step S304. If a plurality of external apparatuses are in the connected state, the process advances to step S308, and the CPU 101 performs a shutdown process. The power controller 104 then automatically turns off the main power source of the apparatus itself, thereby shutting down the power source for the whole printer 2.

On the other hand, if a plurality of external apparatuses are not in the connected state, that is, if one external apparatus is in the connected state, the process advances to step S306 and the CPU 101 determines which interface is in the connected state. In addition, in accordance with the interface in the connected state, the CPU 101 determines whether it is possible to transit to a 0.5-W (Watt) sleep state (to be abbreviated as 0.5-W sleep hereinafter). In the printer 2 according to this embodiment, information indicating whether the sleep power can be set at 0.5 W or less is prestored in the ROM 102, and whether to transit to 0.5-W sleep or turn off the power source is determined based on this information. For example, necessary power when each interface is in the connected state is defined in the information. By referring to this information, the CPU 101 can calculate minimum necessary power by using information of the interface in the connected state as well. In this step, whether it is possible to transit to the 0.5-W sleep state is determined. However, the present invention is not limited to this, and it is also possible to perform determination equivalent to step S306 by confirming the types or number of interfaces. For example, it is possible to transit to the power-off state (a second power state) for a USB connection, and transit to the sleep state (a first power state) for a LAN connection. Alternatively, it is possible to transit to the power-off state (second power state) if there are two or more connections, and transit to the sleep state (first power state) if there is one or less connection. If there are two or more connections, it is also possible to make a predetermined interface communicable, and turn off the power sources of other interfaces. For example, if both the USB and LAN are in the connected state when the interface states are confirmed in step S304, it is possible to maintain the connected state of the LAN as a predetermined interface, and set the USB in the power-off state.

If only the WLAN I/F unit 108 is in the connected state in step S306, the CPU 101 determines that the electric power will exceed 0.5 W in the sleep state by referring to the information in the ROM 102. Therefore, the CPU 101 advances the process to step S308, and turns off the power source. On the other hand, if only the LAN I/F unit 107 is in the connected state, the CPU 101 determines that 0.5-W sleep is possible, and advances to step S307.

In step S307, the CPU 101 causes the power controller 104 to stop power supply to the interface units except for the LAN I/F unit 107, and simultaneously changes the LAN I/F unit 107 to minimum necessary power supply, thereby transiting to 0.5-W sleep. After that, the process advances to step S309. Also, the CPU 101 stops power supply to the engine controller 110, and stops power supply to the panel controller 109 except for a switch for resumption from sleep. In step S309, the CPU 101 maintains the sleep state until a print instruction from the LAN I/F 107 or an instruction from the resuming switch of the panel is received. When the resuming instruction is received, the process returns to step S301.

As has been explained above, the image processing apparatus according to this embodiment confirms the connected state of each interface when a predetermined time has elapsed after printing is complete (after image processing is complete), and determines whether it is possible to transit to 0.5-W sleep in which a power state of 0.5 W or less is maintained. If the transition to 0.5-W sleep is possible, the image processing apparatus executes sleep control for transiting to the sleep state. If the transition to 0.5-W sleep is impossible, the image processing apparatus turns off the power source. Consequently, the image processing apparatus according to this embodiment can execute power saving control more effectively. For example, it is possible to reduce unnecessary turning-off of the power source, thereby reducing an unnecessary power consumption and unnecessary standby time caused by reboot.

Figure 3:
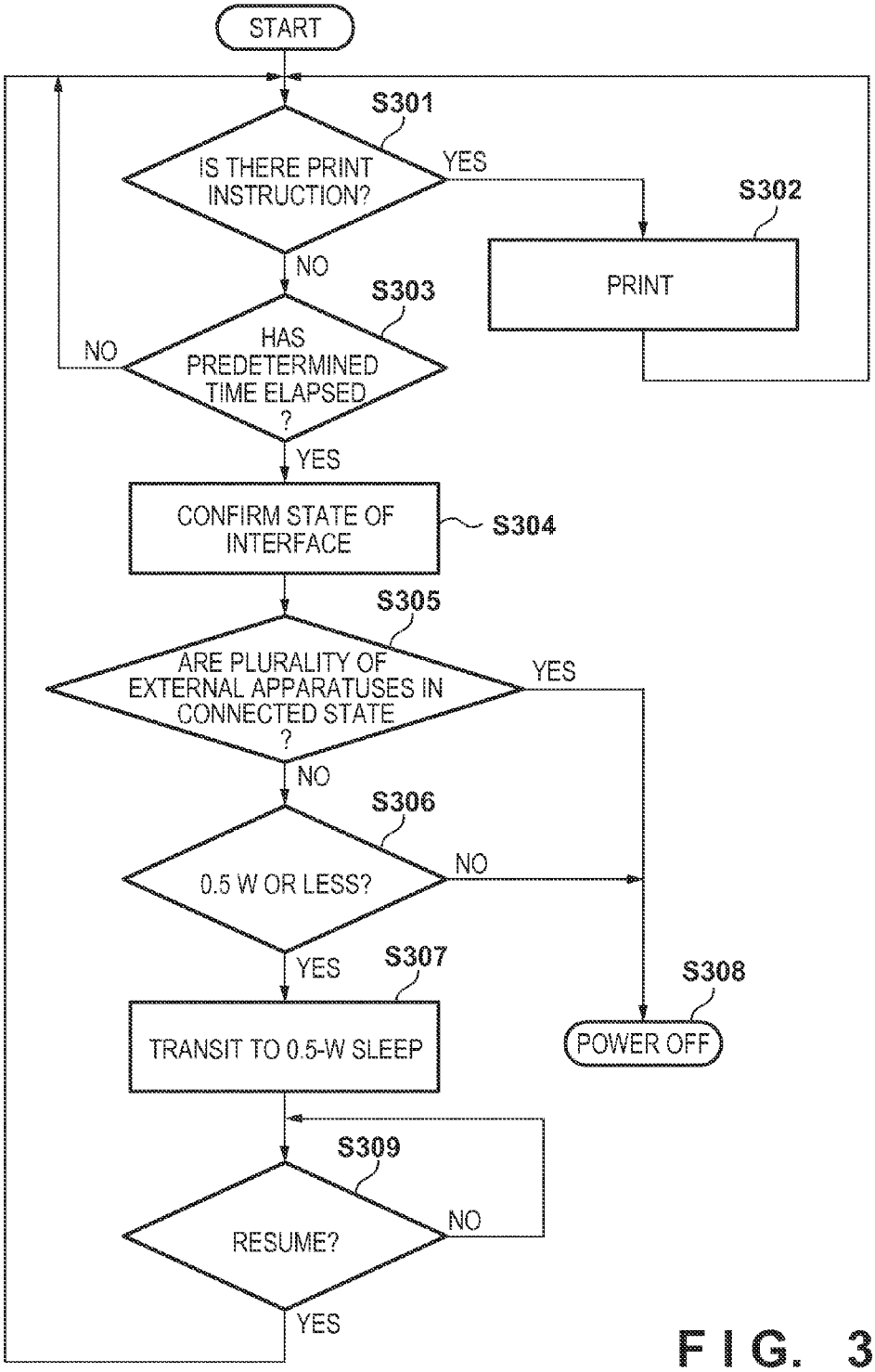
FIG. 3 is a flowchart according to the first embodiment.

Note that in this embodiment, power saving control as explained with reference to FIG. 3 is executed when the predetermined time has elapsed after printing is complete. However, the present invention is not limited to this control. For example, power saving control may also be performed if a time during which no processing is performed has exceeded a predetermined time in the image processing apparatus of the present invention. Also, 0.5 W is used as the reference condition for transition to the sleep state in this embodiment, but this is merely an example. That is, the transition condition can be changed in accordance with a system in which the image processing apparatus is installed.

<Second Embodiment>

Figure 4:
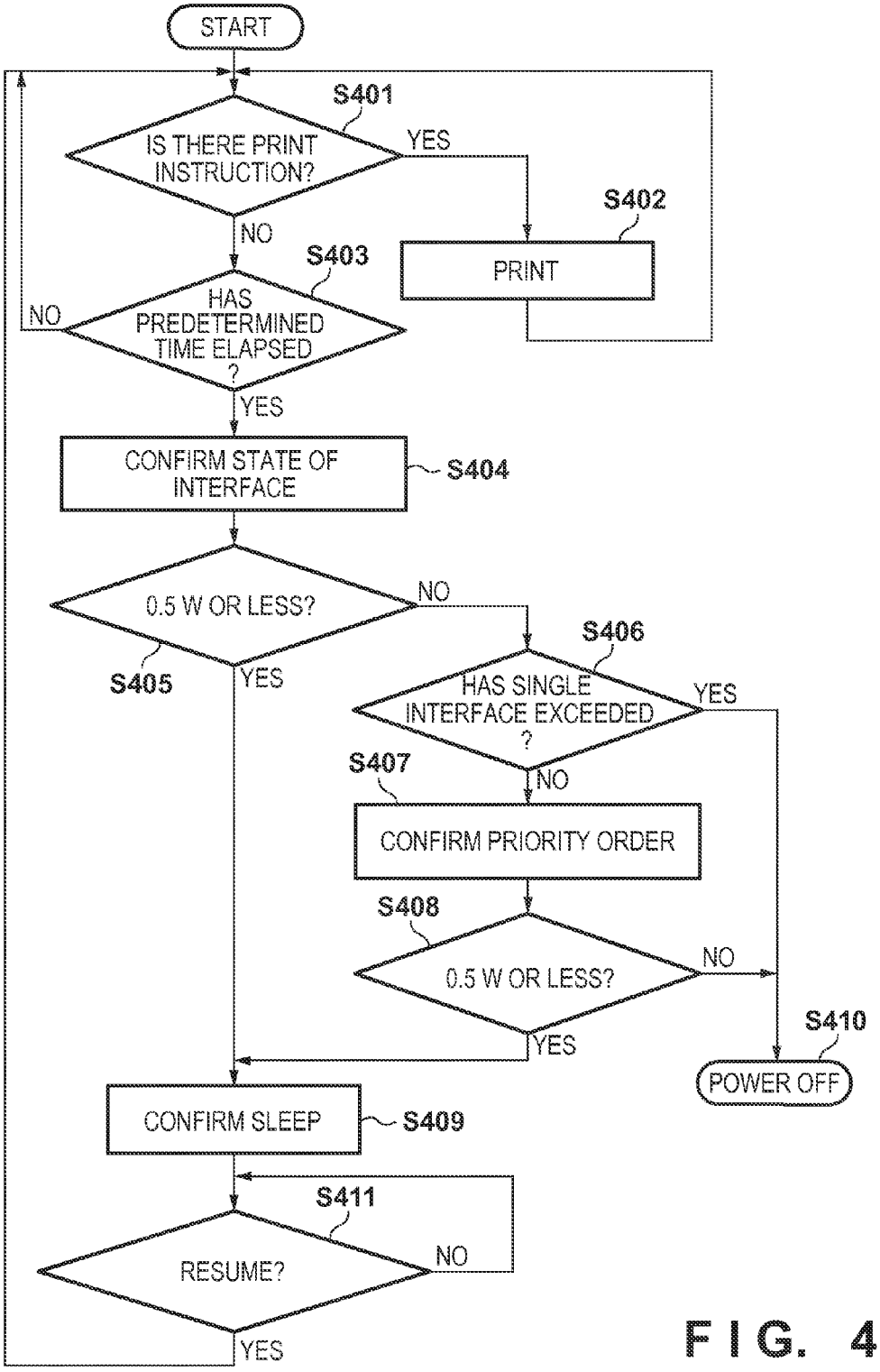
FIG. 4 is a flowchart according to the second embodiment.

The second embodiment of the present invention will be explained below with reference to FIGS. 4 and 6. In the above-mentioned embodiment, the connected states of the interfaces are confirmed, and, if a plurality of external apparatuses are in the connected state, it is determined that the condition of 0.5-W sleep cannot be satisfied, and the power source is turned off. In this embodiment, however, even when a plurality of external apparatuses are in the connected state, the priority order is given to the interfaces such that a specific interface is kept connected and other interfaces are disconnected, thereby transiting to a sleep mode. Note that an explanation of the same components and control operations as those of the above-mentioned first embodiment will be omitted.

<Power Saving Control>

The procedure of power saving control according to this embodiment will be explained below with reference to FIGS. 4 and 6. The processing to be explained below is controlled by a CPU 101 and various programs (firmware) stored in a ROM 102. Note that processes in steps S401 to S404 are the same as those in steps S301 to S304 of FIG. 3, so an explanation thereof will be omitted.

In step S405, the CPU 101 determines whether it is possible to transit to sleep at 0.5 W or less, regardless of the number of interfaces in the connected state. More specifically, the CPU 101 refers to a management table 600 shown in FIG. 6 stored in the ROM 102, and determines whether 0.5-W sleep can be achieved. If 0.5-W sleep cannot be achieved, the process advances to step S406. If 0.5-W sleep can be achieved, the process advances to step S409. Note that in this embodiment, determination processes in steps S406 to S408 (to be described later) are performed if 0.5-W sleep cannot be achieved. However, it is also possible to advance to step S410 without performing these determination processes, and turns off a printer 2.

The management table 600 shown in FIG. 6 will be explained below. The management table 600 defines a connected state 601, 0.5 W or less 602, and priority order 603 by associating them with each other. The connected state 601 defines a combination of interfaces in the connected state. The 0.5 W or less 602 defines information indicating whether 0.5 W or less can be achieved by an interface in the connected state 601. For example, FIG. 6 defines that 0.5 W or less can be achieved when the connected state 601 is a USB or LAN, and cannot be achieved for other interfaces or other combinations.

The priority order 603 defines information of an interface whose connected state is to be given priority, in an item for which a plurality of interfaces are in the connected state. Therefore, no information of the priority order is defined for a single interface. Referring to FIG. 6, when the connected state 601 is USB+LAN, that is, when a USB (USB I/F unit 106) and a LAN (LAN I/F unit 107) are in the connected state, the connected state of the LAN designated in the priority order 603 is preferentially maintained.

Referring back to FIG. 4, in step S406, the CPU 101 determines whether a single connection has exceeded 0.5 W. If even a single connection cannot satisfy 0.5 W, the process advances to step S410, and the CPU 101 turns off the printer 2. On the other hand, the process advances to step S407 if 0.5 W cannot be satisfied when a plurality of external apparatuses are in the connected state.

In step S407, the CPU 101 confirms the priority order by referring to the management table 600 stored in the ROM 102. Note that the user can freely set the priority order in the management table 600. An operation when, for example, the USB and LAN are in the connected state will be explained below.

When the USB and LAN are in the connected state, the CPU 101 refers to the management table, and determines that the LAN is an interface when transiting to sleep, because the LAN is preset in the priority order 603.

Figures 5, 6:
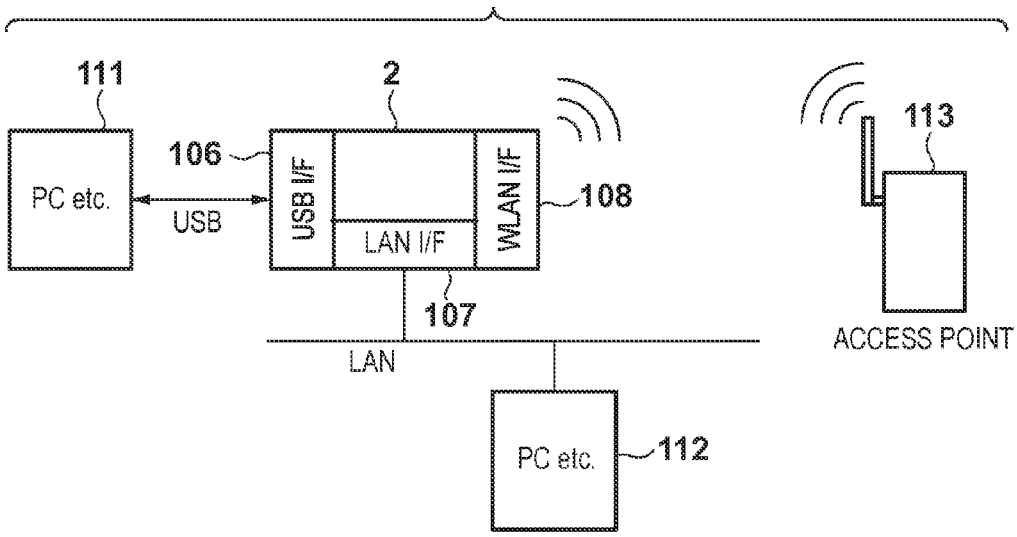
FIG. 5 is a view showing connections to external apparatuses according to the first embodiment.
FIG. 6 is a management table showing the electric power and priority order according to the first embodiment.

In step S408, the CPU 101 confirms power consumption when sleep is set for the LAN based on the management table shown in FIG. 6, and determines to switch to a single connection of the LAN because the power consumption is 0.5 W or less. In this step, since the 0.5 W or less 602 in the management table 600 defines that the LAN can achieve 0.5 W or less, the CPU 101 determines that 0.5 W or less is possible, and advances to step S409. If the management table 600 defines that the LAN cannot achieve 0.5 W or less, the CPU 101 advances the process to step S410, and turns off the printer 2.

In step S409, the CPU 101 causes a power controller 104 to stop power supply to the interface units except for the LAN I/F unit 107, and changes the LAN I/F unit 107 to minimum necessary power supply. Note that if the process advances to step S409 from the determination in step S408, power supply to the USB I/F unit 106 in the connected state is stopped. In this embodiment as described above, even when a plurality of external apparatuses are in the connected state, power supply to a given interface in the connected state is stopped in accordance with the predetermined priority order, unlike in the above-mentioned first embodiment. In addition, power supply to an engine controller 110 is also stopped, and power supply to a panel controller 109 is stopped except for a switch for resumption from sleep. In step S411, the CPU 101 maintains the sleep state until a print instruction from the LAN I/F unit 107 or an instruction from the resuming switch of the panel is received. When the resuming instruction is received, the process returns to step S401.

As has been explained above, the image processing apparatus according to this embodiment determines, when performing power saving control, whether 0.5 W or less can be achieved from the present connected state in accordance with the management table. In addition, if 0.5 W or less cannot be achieved when a plurality of external apparatuses are in the connected state, this image processing apparatus determines whether 0.5 W or less can be achieved by stopping power supply to a given external apparatus in accordance with the priority order. Accordingly, the image processing apparatus according to this embodiment can execute power saving control more effectively. For example, it is possible to reduce unnecessary turning-off of the power source, thereby reducing an unnecessary power consumption and unnecessary standby time caused by reboot.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-031042 filed on Feb. 15, 2012, which is hereby incorporated by reference herein in its entirety.

What is claimed is:

1. An image processing apparatus comprising a plurality of interfaces for connecting an external apparatus, comprising:

a confirmation unit configured to confirm, in a case where a condition for changing a power state of the image processing apparatus is satisfied, an interface which is able to communicate with an external apparatus;

a determination unit configured to determine, based on a confirmation result by said confirmation unit, whether or not the image processing apparatus transits to a sleep state in which at least one of the plurality of interfaces is communicable; and a power control unit configured to transit the image processing apparatus to the sleep state if said determination unit has determined that the image processing apparatus transits to the sleep state, and transit the image processing apparatus to a power-off state in which the plurality of interfaces are incommunicable if said determination unit has determined that the image processing apparatus does not transit to the sleep state.

2. The apparatus according to claim 1, wherein said determination unit determines that the image processing apparatus does not transit to the sleep state if a plurality of interfaces in the connected state exist.

3. The apparatus according to claim 1, further comprising a storage unit configured to store power consumption in the sleep state for each of the plurality of interfaces, wherein said determination unit determines that the image processing apparatus transits to the sleep state in a case where only one interface is in the connected state and a power consumption of the one interface in the sleep state is not more than a predetermined power value.

4. The apparatus according to claim 1, further comprising a storage unit configured to store information indicating whether an operation at not more than a predetermined power is possible in the sleep state, for each interface in the connected state and each combination of a plurality of interfaces in the connected state, wherein said determination unit determines that the image processing apparatus transits to the sleep state if an interface in the connected state confirmed by said confirmation unit is defined, in said storage unit, as operable at not more than the predetermined power, and determines that the image processing apparatus does not transit to the sleep state if the interface is defined, in said storage unit, as inoperable at not more than the predetermined power.

5. The apparatus according to claim 4, wherein said storage unit further stores, for each interface in the connected state and each combination of a plurality of interfaces in the connected state, a priority order of a plurality of interfaces for a combination of the plurality of interfaces, and said determination unit determines whether an interface in the connected state confirmed by said confirmation unit is a combination of a plurality of interfaces, if the interface in the connected state is defined, in said storage unit, as inoperable at not more than the predetermined power, determines that the image processing apparatus does not transit to the sleep state if the interface is a single interface, and refers to the priority order in said storage unit if the interface is a combination of a plurality of interfaces, determines that the image processing apparatus transits to the sleep state if an interface designated as an interface whose connected state is to be preferentially maintained is operable at not more than the predetermined power, and determines that the image processing apparatus does not transit to the sleep state if the interface designated as an interface whose connected state is to be preferentially maintained is inoperable at not more than the predetermined power.

6. The apparatus according to claim 5, wherein if said determination unit determines that the transition to the sleep state in which the image processing apparatus operates at not more than a predetermined power is possible, said power control unit stops power supply to an interface, among the plurality of interfaces in the connected state, which is not designated as an interface whose connected state is to be preferentially maintained, thereby transiting the image processing apparatus to the sleep state.

7. The apparatus according to claim 1, wherein the plurality of interfaces comprise a LAN interface and a USB interface, and said power control unit performs transition to a sleep state in which said LAN interface is communicable and said USB interface is incommunicable, if said determination unit has determined that the image processing apparatus transits to the sleep state, and performs transition to a power-off state in which both of said LAN interface and said USB interface are incommunicable, if said determination unit has determined that the image processing apparatus does not transit to the sleep state.

8. A control method for an image processing apparatus comprising a plurality of interfaces for connecting an external apparatus, comprising:

confirming, by a confirmation unit, in a case where a condition for changing a power state of the image processing apparatus is satisfied, an interface which is able to communicate with an external apparatus;

determining, by a determination unit, based on a confirmation result by the confirmation unit, whether or not the image processing apparatus transits to a sleep state in which at least one of the plurality of interfaces is communicable; and controlling, by a power control unit, to transit the image processing apparatus to the sleep state if the determination unit has determined that the image processing apparatus transits to the sleep state, and transit the image processing apparatus to a power-off state in which the plurality of interfaces are incommunicable if the determination unit has determined that the image processing apparatus does not transit to the sleep state.

9. A computer-readable storage medium storing a computer program for causing a computer to execute each step in a control method for an image processing apparatus cited in claim 8.

* * * * *